US007950554B2

(12) United States Patent
Hoffner et al.

(10) Patent No.: US 7,950,554 B2
(45) Date of Patent: May 31, 2011

(54) HARNESS FOR FIREARM ACCESSORIES

(75) Inventors: Brian Hoffner, Houston, TX (US); Thomas M. Morin, Houston, TX (US); Cecil Going, Houston, TX (US)

(73) Assignee: Brian D. Hoffner, Houston, TX (US)

( * ) Notice: Subject to any disclaimer, the term of this patent is extended or adjusted under 35 U.S.C. 154(b) by 915 days.

(21) Appl. No.: 11/518,570

(22) Filed: Sep. 8, 2006

(65) Prior Publication Data

US 2008/0061098 A1 Mar. 13, 2008

(51) Int. Cl.
*A45F 5/00* (2006.01)

(52) U.S. Cl. ..... 224/661; 224/222; 224/243; 224/677; 224/680

(58) Field of Classification Search ..... 224/192, 224/222, 243, 267, 661, 665, 667, 668, 672, 224/673, 676, 677, 678, 680, 901.4, 907, 224/911, 914, 195, 239, 675, 682, 271, 904
See application file for complete search history.

(56) References Cited

U.S. PATENT DOCUMENTS 1,723,147 A * 8/1929 Fourethier ..... 224/197
2,765,109 A * 10/1956 Barnett ..... 224/241
D248,866 S 8/1978 Gonzales
4,258,871 A * 3/1981 McMahon ..... 224/192
4,883,290 A * 11/1989 Landa ..... 280/814
5,152,443 A * 10/1992 Hagan ..... 224/662
5,215,238 A * 6/1993 Baruch ..... 224/243
5,464,136 A * 11/1995 Eddy ..... 224/666
5,511,705 A * 4/1996 Dreszer ..... 224/666
5,765,738 A 6/1998 Hoffner
6,149,042 A * 11/2000 Rassias ..... 224/661
6,547,118 B2 4/2003 Beletsky et al.
6,698,631 B1 * 3/2004 Haskins ..... 224/148.4
6,701,534 B2 * 3/2004 Guibord ..... 2/338
6,755,331 B2 * 6/2004 Rassias ..... 224/243

* cited by examiner

*Primary Examiner* — Nathan J Newhouse
*Assistant Examiner* — Steven M Landolfi, Jr.
(74) *Attorney, Agent, or Firm* — Browning Bushman P.C.

(57) ABSTRACT

A harness 10 for supporting at least two firearm accessories from a wearer's belt includes a primary support 20, a belt latch 22 for removably connecting the primary support to the belt, and a curvilinear rail 16 secured to the primary support opposite the belt latch for positioning about the thigh of the user. The rail 16 may support a handgun holster 12 and one or more other firearm accessories 14 each spaced along the rail. A strap 30 is provided for removably connecting the rail to the thigh of the wearer. A harness may also support a rail directly from the wearer's belt.

15 Claims, 2 Drawing Sheets

HARNESS FOR FIREARM ACCESSORIES

FIELD OF THE INVENTION

The present invention relates to a harness of the type used by law enforcement, military and security personnel. More particularly, this invention relates to a harness for supporting a handgun and/or one or more other firearm accessories.

BACKGROUND OF THE INVENTION

Law enforcement, military, and security personnel typically prefer to carry a handgun at his or her side. These personnel also typically carry various firearm accessories, including one or more knife holders, firearm clips, flashlights, stun guns or other tactical items, particularly when exposed to high risk operations. Those accessories may not be readily available to the wearer, thereby enhancing the risk. It should also be apparent that one officer may prefer an extra clip and a flashlight along with his handgun, while another officer may prefer a knife holder, a stun gun, and a hand gun.

Presently available equipment does not offer the desired relatively low cost and high reliability for carrying the handgun and related firearm accessories for these personnel. Firearm accessories may not easily fit within a pouch carried by the user, and ready access to such an item through the pouch may be time consuming. Accordingly, personnel frequently do not regularly use a harness for carrying their handgun and related firearm accessories.

U.S. Pat. No. 5,765,738 discloses a harness for supporting a handgun holster. The holster is supported on a belt, with a leg strap securing the holster to the thigh of the user. In order to carry a cartridge magazine and handcuffs, a separate harness is provided for supporting on a belt and securing to the other thigh of the user.

U.S. Pat. No. 6,547,118 discloses a harness for supporting a handgun. Separate pockets are provided for receiving magazines, mace, or handcuffs. Design Pat. 248,866 discloses a leg holster which is presumably supported separate from the belt.

The disadvantages of the prior art are overcome by the present invention, and an improved harness is provided for supporting a handgun and firearm accessories.

SUMMARY OF THE INVENTION

In one embodiment, a harness supports a handgun holster from a wearer's belt, such that the holster is positioned at the thigh of the wearer. The holster comprises a primary support, at least one belt connector for removably securing the primary support to the belt, and a curvilinear rail secured to the primary support opposite the belt connector for positioning about the thigh of the user. The curvilinear rail supports a handgun holster and one or more other firearm accessories each spaced along the rail from the handgun holster. A flexible thigh connector removably attaches the rail to the thigh of the wearer.

In another embodiment, the harness includes a primary support and one or more belt connectors. A curvilinear rail is secured to the primary support opposite a belt connector for positioning about the thigh of the user, with the rail being a monolithic and substantially rigid component supporting each of two or more firearm accessories spaced along the rail. A flexible connector removably connects the rail to the thigh of the wearer.

In yet another embodiment, the harness supports two or more firearm accessories from the wearer's belt. A curvilinear rail supports each of the two or more firearm accessories spaced along the rail, and one or more belt connectors each removably connect the rail to the wearer's belt. The rail includes upper and lower projections, with a gap between projections sized to receive one of the firearm accessories.

The method of the invention includes providing a primary support, removably connecting the primary support to the belt, supporting a curvilinear rail from the primary support opposite the belt for positioning above the thigh of the user, with the rail supporting each of the two or more firearm accessories spaced along the rail, and removably connecting the rail to the thigh of the wearer.

A significant advantage of the present invention is the versatility provided by providing a rail for supporting multiple handgun accessory items at spaced intervals along the rail, with each item being selectively securable to and detachable from the rail.

These and further features and advantages of the present invention will become apparent from the following detailed description, wherein reference is made to the figures in the accompanying drawings.

DETAILED DESCRIPTION OF PREFERRED EMBODIMENTS

Figure 1:
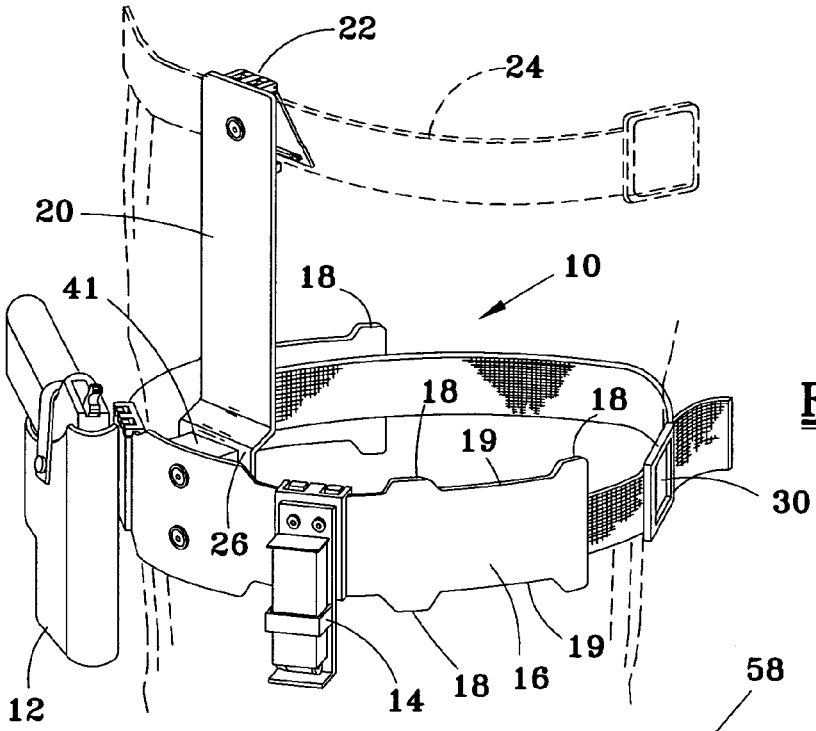
FIG. 1 is a pictorial view of a suitable harness according to the present invention for holding a handgun and firearm accessories.

FIG. 1 illustrates one embodiment of a suitable harness 10 according to the present invention for supporting a handgun holster 12 to receive a handgun, and a clip support 14 each supported at spaced intervals along a generally horizontal rail 16. Rail 16 is a substantially rigid member suitably formed from a plastic material. A primary support 20 is provided for securing to a belt 24 of the user, with the latch 22 at the upper end of primary support 20 provided for selectively securing the support and thus the rail 16 from the belt, while opening the gate of the latch to release the support 20 and the rail 16 from the belt. The support 20 is preferably also fabricated from a rigid plastic material, and includes an offset portion 26 for positioning the rail 16 at a suitable distance from the side of the upper thigh of the user. The rail 16 is thus a monolithic and substantially rigid component. A spacer block 41 may also be used for this purpose. A leg strap 30 having a conventional strap retainer is provided for securing about the leg of the user, so that the combination of the belt 24 and the strap 30 firmly position the firearm and the various accessories with respect to the body of the wearer. Various types of cords, straps, or other flexible connectors may be used to secure the rail to the leg of the user.

Figure 2:
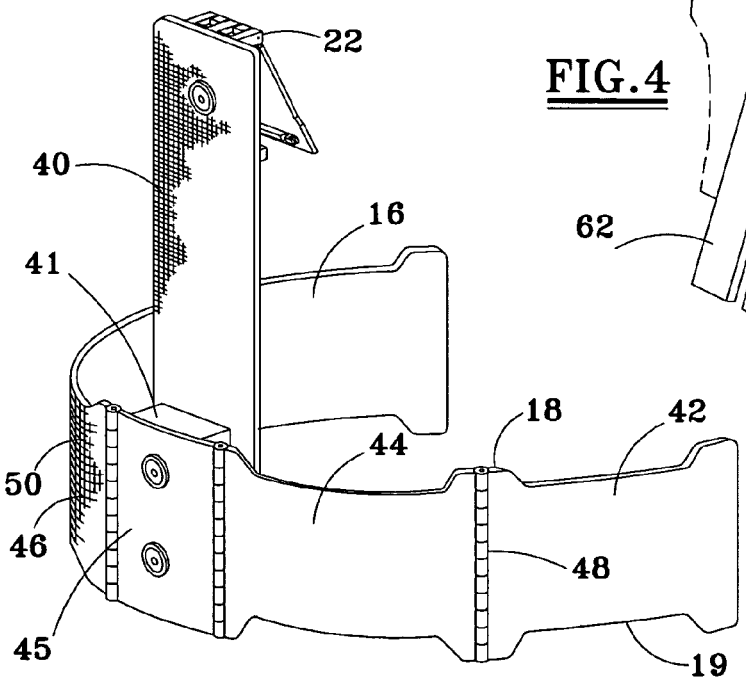
FIG. 2 depicts a portion of another embodiment of the harness shown in FIG. 1, with the holster, firearm accessories and leg strap removed. The primary support is flexible and the generally horizontal rail is formed from pivotable sections.
Figure 3:
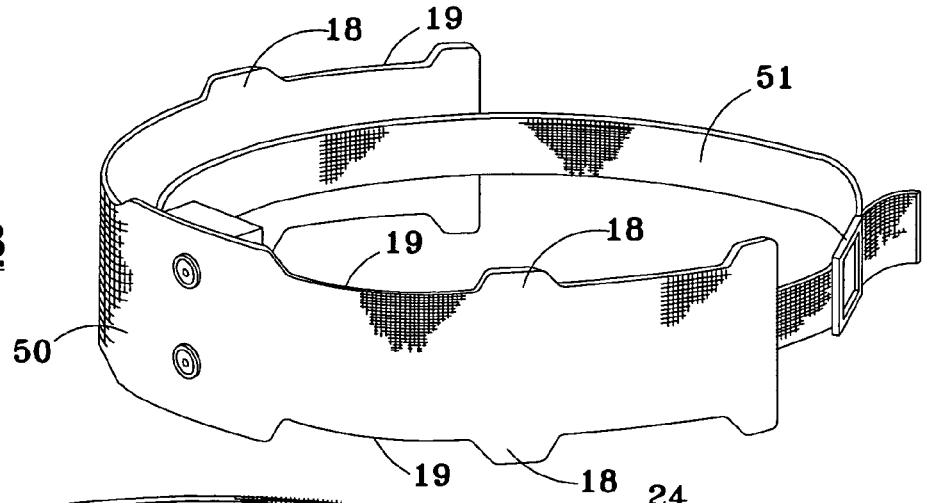
FIG. 3 discloses another embodiment of a portion of a harness, with the rail being a flexible member.

For the embodiment as shown in FIG. 2, the rigid support 20 has been replaced with a generally pliable fabric matting or leather material 40. The block 41 may be used to position the rail 16 outward from the body of the user. The rail itself is composed of rigid plastic segments 42, 44, 46, with the various segments being joined to each other or to the plate 45 secured to the block 41 by a suitable hinge 48. The matting material 40 may also be used with the rail as shown in FIG. 1 or 3. The hinged section 42, 44 may be used with the rigid support 20 shown in FIG. 1.

Referring now to FIG. 3, there is shown a harness wherein the rail 50 is formed from a suitable pliable material, such as a fabric matting or leather method. The fabric strap 51 is shown for tying the rail 50 to the thigh of the user.

Figure 4:
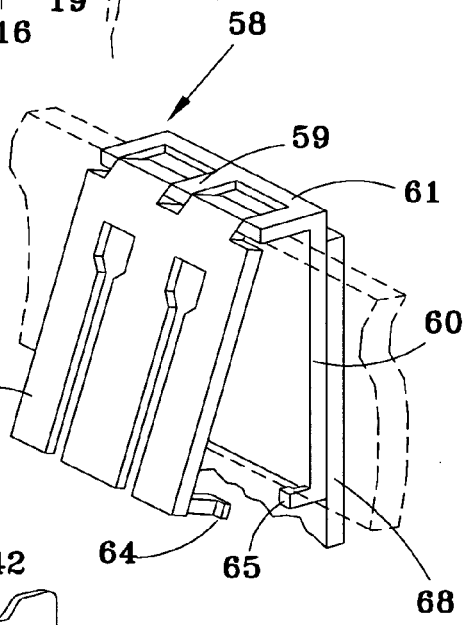
FIG. 4 illustrates a portion of another harness with various firearm accessories supported at spaced intervals along the rail.
Figure 5:
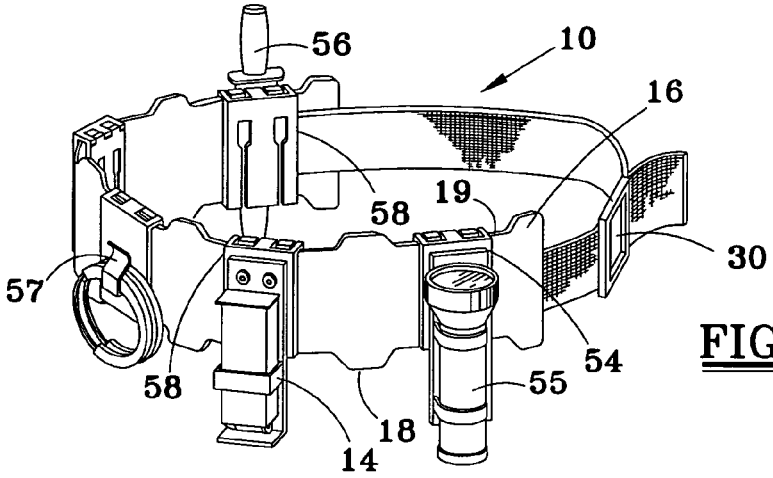
FIG. 5 illustrates in greater detail one of the latches generally shown in FIGS. 1 and 4.

FIGS. 1, 2 and 3 generally illustrate that the rail comprises a relatively thin curved sheet with upper and lower projections 18, such that a cutouts 19 exist between the projections and are each sized for receiving a suitable latch, like latch 58 shown in FIG. 4. Latch 58 which secures each holster or other firearm accessory to the rail preferably is substantially the same as the latch 22 to secure the primary support to the belt. Limited circumferential movement of the latch and thus the holster and firearm assembly along the circumference of the rail is thus permitted. FIG. 5 illustrates the rail supporting a clip support 14, a flashlight receiving receptacle 54 for receiving a flashlight 55, a batton receptacle 56, and a handcuff retainer 57.

FIG. 4 shows in greater detail a suitable latch as generally shown in FIGS. 1 and 2. The latch 58 includes a base plate 60, which is conventionally provided on the outside of the rail or the outside of the belt. The item supported thus is secured to and extends downward from the base plate 60. Upper portion 61 including a plurality of hinge fingers 59 provided for receiving a door 62, which pivots at the ends of the fingers 59. A plurality of flexible snaps 64 are provided for engaging locking members 65 on the lower end of the base plate 60, so that the gate can be snapped to the closed position, and subsequently the tabs 64 pressed together and the gate pivoted free from the base of the base plate 60 to remove the latch and the item supported on the latch.

Figure 6:
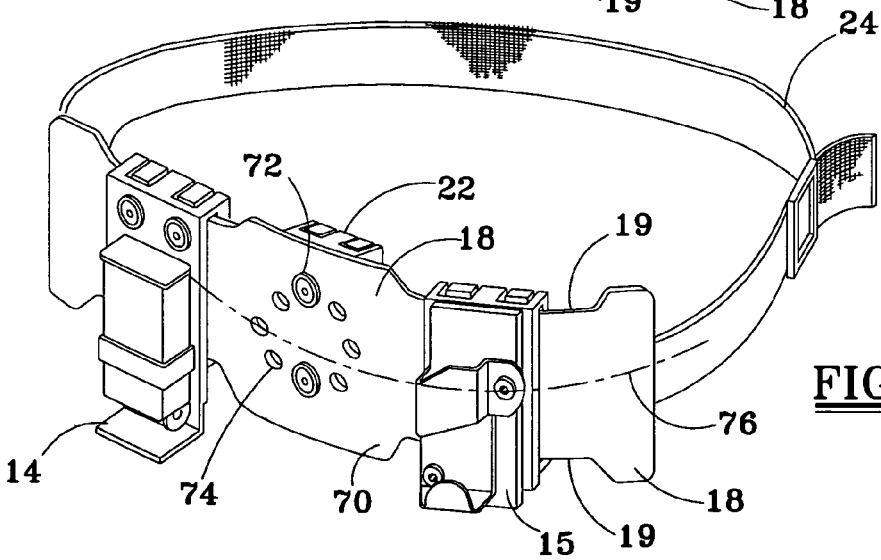
FIG. 6 illustrates another embodiment of a harness wherein the rail is clipped directly to the user's belt.

FIG. 6 depicts yet another embodiment of a suitable firearm accessory harness, wherein a shortened rail 70 includes one or more clips 22 for securing the rail directly to the belt 24 of the wearer. No primary support is thus required. Rail 70 includes the projections 18 and the recesses 19 as previously described each for receiving a suitable clip for supporting a firearm accessory, including one or more bullet clips 14, a clip retainer 15, or another firearm accessory.

A particular feature of the harness as shown in FIG. 6 is that a pair of replaceable pins 72 are provided for selectively positioning within holes 74 in the rail 70 for mating with selected holes in the base plate 60 of the clip 22. This allows the centerline 76 of the rail 70 to be in a generally horizontal position, as shown in FIG. 6, but the centerline 76 of the rail may also be angled, e.g., at 30°, 45°, or 60°, so that the rail more readily accommodates a wearer who desires that the firearm accessory equipment be positioned at a selected angle along the rail, thereby facilitating quick and easy access to the firearm accessories. Rotatable locks other than a pair of pins may be used, and the extra holes for selective alignment to receive the pins could be provided in the base plate of the latch 22 rather than in the rail.

As a modification to the device as shown in FIG. 6, two clips spaced along the rail may be provided for more reliably attaching the rail to the user's belt, although the rail could then not be easily inclined relative to the horizontal belt.

The user may thus remove the pins 72, rotate the rail in either desired direction and to a desired angle relative to the clip 22, then reinsert the pins 72 so that the rail will be at a desired angular position, or alternatively a desired horizontal position, for use by the wearer.

The term "firearm accessories" as used herein includes two or more of a firearm holster, a knife holder, a firearm clip (or magazine), a flashlight, a stun gun, a distraction device, a smoke grenade, a handcuff clip, and communications equipment.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A harness for supporting two or more firearm accessories from a wearer's belt extending circumferentially about the wearer's waist and positioned about the thigh of the wearer, comprising:

a primary support;

a belt connector for removably connecting the primary support to the belt;

a substantially rigid curvilinear rail secured to the primary support opposite the belt connector for positioning about the thigh of the wearer and curved circumferentially to conform to the thigh of the wearer, the substantially rigid curvilinear rail having an upper surface and a lower surface and a plurality of vertical cutouts in the rail each forming a reduced vertical thickness circumferentially between upper and lower projections extending vertically above and below the reduced vertical thickness of the vertical cutouts in the rail, the reduced vertical thickness in the rail accepting a latch of a respective firearm accessory, and the upper and lower vertical projections sized to limit travel of the firearm accessory along a horizontal length of the curvilinear rail, the rail supporting each of at least two or more firearm accessories spaced horizontally on a respective cutout in the rail; and a flexible connector for removably connecting the rail to the thigh of the wearer.

2. A harness as defined in claim 1, wherein the primary support is a rigid component, and positions the lower end of the primary support outwardly from the upper end of the primary support.

3. A harness as defined in claim 1, wherein the primary support is a flexible webbing.

4. A harness as defined in claim 1, wherein the substantially rigid curvilinear rail includes multiple sections which are hingedly connected.

5. A harness as defined in claim 1, wherein the two or more firearm accessories are selected from a group consisting of a holster, a knife holder, a flashlight, a firearm clip, a stun gun, a distraction device, a smoke grenade, a handcuff clip, and communications equipment.

6. A harness as defined in claim 1, wherein the latch supports each of the two or more firearm accessories on the rail, the latch having a gate positioned interior of the rail when in the closed position, with the gate closed to support the latch on the rail, and the gate opened to remove the latch from the rail.

7. A harness as defined in claim 1, wherein the latch has a movable gate, the gate being positioned about the curvilinear rail when in the closed position, and the gate opened to remove the firearm accessory from the curvilinear rail.

8. A harness for supporting two or more firearm accessories from a wearer's belt extending circumferentially about the wearer's waist, comprising:

a primary support;

a belt connector for removably connecting the primary support to the belt;

a curvilinear rail secured to the primary support opposite the belt connector and curved circumferentially for positioning about the thigh of the wearer, the rail being a monolithic and substantially rigid component supporting each of the two or more firearm accessories spaced horizontally along the rail, the substantially rigid curvilinear rail having an upper surface and a lower surface and a plurality of vertical cutouts in the rail each forming a reduced vertical thickness circumferentially between vertical upper and lower projections extending vertically above and below the reduced vertical thickness, the reduced vertical thickness of the rail accepting a latch of a respective firearm accessory, and the upper and lower vertical projections sized to limit travel of the firearm accessory along a horizontal length of the curvilinear rail between one or more vertical projections; and a flexible connector for removably connecting the rail to the thigh of the wearer.

9. A harness as defined in claim 8, wherein the latch supports each of the two or more firearm accessories on the rail, the latch having a gate positioned interior of the rail when in the closed position, with the gate closed to support the latch on the rail, and the gate opened to remove the latch from the rail.

10. A method of supporting two or more firearm accessories from a wearer's belt extending circumferentially about the wearer's belt, comprising:

providing a primary support;

removably connecting the primary support to the belt;

supporting a substantially rigid curvilinear rail from the primary support opposite the belt and curved circumferentially for positioning about the thigh of the wearer, the substantially rigid curvilinear rail having an upper surface and a lower surface and a plurality of vertical cutouts in the rail each forming a reduced vertical thickness circumferentially between upper and lower vertical projections extending vertically above and below the reduced vertical thickness, the reduced vertical thickness of the rail accepting a latch of a respective firearm accessory, and the upper and lower vertical projections sized to limit travel of the firearm accessory along a horizontal length of the curvilinear rail, the rail supporting each of at least two or more firearm accessories spaced horizontally on a respective cutout in the rail; and removably connecting the rail to the thigh of the wearer.

11. A method as defined in claim 10, when the rail is formed from plastic.

12. A method as defined in claim 10, wherein the firearm accessories are selected from a group consisting of a holster, a knife holder, a flashlight, a firearm clip, a stun gun, a distraction device, a smoke grenade, a handcuff clip, and communications equipment.

13. A harness for supporting two or more firearm accessories from a wearer's belt extending circumferentially about the wearer's waist, comprising:

a substantially rigid curvilinear rail supporting each of the two or more firearm accessories spaced along the rail, the substantially rigid curvilinear rail being curved circumferentially to conform to the thigh of the wearer and having an upper surface and a lower surface and a plurality of vertical cutouts in the rail each forming a reduced vertical thickness circumferentially between upper and lower vertical projections extending vertically above and below the reduced vertical thickness, the reduced vertical thickness of the rail accepting a latch of a respective firearm accessory, and the upper and lower vertical projections sized to limit travel of the firearm accessory along a horizontal length of the curvilinear rail, the rail supporting each of at least two or more firearm accessories spaced horizontally on a respective cutout in the rail; and one or more belt connectors each removably connecting the rail to the wearer's belt.

14. A harness as defined in claim 13, wherein each belt connector includes a latch having a movable gate, the gate being positioned circumferentially about the belt when in the closed position, and the gate opened to remove the harness from the belt.

15. A harness as defined in claim 13, wherein the one or more belt connectors includes a single belt connector, and the rail is rotatable to a selected position then locked in that position relative to the belt connector, such that when the harness is worn, the rail may be angled relative to the wearer's belt.

* * * * *